United States Patent [19]

Michel

[11] 4,406,611

[45] Sep. 27, 1983

[54] METHOD FOR OPERATING A GASIFICATION BURNER/HEATING BOILER INSTALLATION

[75] Inventor: Alfred Michel, Erlangen, Fed. Rep. of Germany

[73] Assignee: Siemens Aktiengesellschaft, Munich, Fed. Rep. of Germany

[21] Appl. No.: 265,458

[22] Filed: May 20, 1981

[30] Foreign Application Priority Data

May 22, 1980 [DE] Fed. Rep. of Germany ..... 3019622

[51] Int. Cl.[3] ..... F23N 5/24

[52] U.S. Cl. ..... 431/12; 431/76; 236/15 BD

[58] Field of Search ..... 431/12, 76, 89, 90; 236/15 BD, 15 E

[56] References Cited

U.S. PATENT DOCUMENTS 4,230,443 10/1980 Berg et al. ..... 431/115

FOREIGN PATENT DOCUMENTS 2915211 10/1980 Fed. Rep. of Germany .... 236/15 E
55-82226 6/1980 Japan ..... 431/76
7811831 6/1980 Netherlands ..... 236/15 BD
1515302 6/1978 United Kingdom ..... 236/15BD
1571906 7/1980 United Kingdom ..... 236/15 BD

OTHER PUBLICATIONS

"Computerized Control System for Improved Combustion Efficiency", Gulitz, *IBM Technical Disclosure Bulletin*, vol. 18, No. 2, Jul. 1975, pp. 428–429.

*Primary Examiner*—Samuel Scott
*Assistant Examiner*—Margaret A. Focarino
*Attorney, Agent, or Firm*—Kenyon & Kenyon

[57] ABSTRACT

The invention relates to a method for operating a gasification (or vaporizing) burner/heating boiler installation and has the objective to develop such an installation in such a manner that it can be operated controllably. According to the invention, the required burner output is determined for this purpose from the outside air temperature, and then the mass flows of the heating oil and the air are controlled as a function of the demanded burner output, deviations from the stoichiometric ratio between the heating oil and the air being leveled-out by means of a lambda-probe arranged in the exhaust gas stream.

8 Claims, 3 Drawing Figures

METHOD FOR OPERATING A GASIFICATION BURNER/HEATING BOILER INSTALLATION

BACKGROUND OF THE INVENTION

The present invention relates to a method for operating a gasification burner/heating boiler installation.

In conventional heating boiler installations, oil burners are used on a large scale. Conventional oil burners of medium rating atomize the heating or fuel oil by means of a nozzle and burn it with excess air in order to minimize the development of soot. However, the atomizing burner output is difficult to control continuously, and then only in a closely defined range. For this reason, atomizing burners for heating boiler installations are operated intermittently so that the average of the output corresponds to the heat demand.

In the operation of conventional atomizing burners, the oil mass flow is given by the viscosity of the heating oil, the cross section of the atomizer nozzle and the oil pressure. The air mass flow is adjusted only when starting the operation and for servicing to the instantaneous value of pressure and temperature of the suction air as a volume flow, and specifically, to so high a value of air excess ($\lambda \iota 1.2$ to 1.5) that the CO content and the soot number of the exhaust gas do not exceed predetermined limits. Control of the mass ratio between the fuel, i.e., the oil, and air does not take place, so that the combustion air number changes with the viscosity as well as with the H/C and the S/C ratio of the fuel and with the temperature, the pressure and the water vapor content of the drawn-in combustion air in an uncontrolled manner. Along with this uncontrolled change, however, goes the danger of soot formation and a variation of the efficiency.

From U.S. Pat. No. 4,230,443, a continuously controlled gasification or vaporizing burner is known. This burner is based on the principle of two-stage combustion where, in the first stage, heating oil is gasified in a catalytic reactor by partial oxidation with air (gasification or primary air) at air numbers between 0.05 and 0.2 and preferably at about 0.1. The so-obtained product gas, the so-called fuel gas, is then burned stoichiometrically with the remaining air (combustion or secondary air), high combustion temperatures being obtained. The composition of the exhaust gas corresponds substantially to that of the thermodynamic equilibrium at the combustion temperature.

SUMMARY OF THE INVENTION

It is an object of the present invention to operate a gasification burner/heating boiler installation in a controlled manner, i.e., in such a manner that continuous heat output control of a stoichiometric heating oil gasification burner as well as control of the stoichiometry of fuel and air supply becomes possible.

According to the present invention, this and other objects are achieved by the provision that the required burner output is determined from the ambient air temperature; that the mass flows of heating oil and air are controlled as a function of the (demanded) burner output; and that deviations from the stoichiometric ratio between fuel oil and air are controlled by means of a $\lambda$-probe arranged in the exhaust gas stream.

In the operation of a heating boiler installation, the required fuel and air mass flow, for constant efficiency of the installation, is directly proportional to heat requirement. The heat requirement, for example, of a residential building, in turn depends, like the forward flow temperature of the boiler, approximately linearly on the ambient or outside air temperature. This relationship is shown schematically in FIG. 1. It can be seen from FIG. 1 that the output requirement varies approximately between 15 and 100% of the burner rating (outside air temperature: +15° to −15° C.).

In the method according to the present invention, the necessary burner output for controlling the heat is, therefore, first determined from the outside air temperature. The corresponding air and heating oil mass flows are adjusted preferably by regulating the speed of a drive which is common for the air compressor and oil pump. The throughput quantities can be set, for example, by performance characteristic control of the speed. Instead of controlling the burner output via speed control of the pump and compressor drive, however, the throughput also can be set for constant speed, advantageously by controlling bypasses to the air compressor and the oil pump.

Deviations from the stoichiometric ratio between fuel and air are leveled out advantageously with the method according to the present invention by changing a bypass to the air compressor or to the oil pump. The control signal is supplied by a so-called lambda-probe arranged in the hot exhaust gas flow.

The heating oil mass flow can further be conveyed by an electrically driven oscillating-piston pump, the throughput being set by performance characteristic control of the frequency and/or of the amplitude of the drive current. Tha air mass flow can then be supplied, for example, by a compressor, the throughput of which is set by performance characteristic control of the speed.

In this case, deviations from the stoichiometric ratio between fuel and air are leveled out by changing the frequency and/or amplitude of the drive current of the oscillating-piston pump or by changing the speed of the compressor or also by changing a bypass to the oil pump and/or to the air compressor. Also here, the lambda-probe supplies the control signal.

A lambda-probe is an oxygen-sensitive electrochemical element which contains a solid electrolyte which conducts oxygen ions at the measuring temperature, and two oxygen-dissolving catalyst electrodes. Such an element generates an electromotive force (EMF) as long as the partial oxygen pressure at the two electrodes is different. If one of the two electrodes is, as in the present case, in contact with the exhaust gas of the burner and the other electrode is in contact with the suction air atmosphere, the EMF increases abruptly during the transition from lean exhaust gas ($\lambda > 1$) to rich exhaust gas ($\lambda < 1$). This voltage jump is used in the method according to the present invention for controlling the stoichiometry of the input material mixture. The voltage jump is limited during the transition to the rich exhaust gas by the fact that the electrochemical element then acts as a fuel cell due to the combustible components which then occur in the exhaust gas.

In the method according to the present invention, the lambda-probe is preferably arranged in the fire box of the heating boiler, at least partially. This ensures that the minimum operating temperature, and thereby the operability of the probe, is assured under all operating conditions.

The method according to the present invention has in particular the advantage that due to the use of a lambda-probe, the control of the stoichiometry of the input material mixture is independent of the temperature, the pressure and the water vapor content of the suction air and also independent of the viscosity as well as the H/C and S/C ratio of the heating oil. Therefore, neither the danger of soot formation nor a variation of the efficiency is present. In addition, this method, due to the use of a gasification or vaporizing burner, offers the safety of heating oil storage as well as the advantages of gas operation.

DETAILED DESCRIPTION OF THE INVENTION

Figure 1:
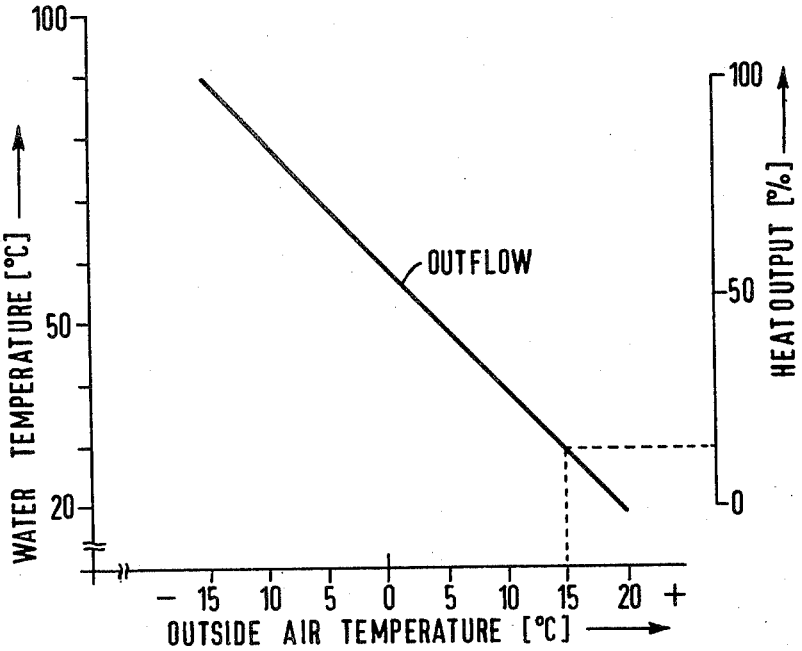
FIG. 1 is a graph showing the relationship between boiler water temperature and heat output of the heating boiler installation.

In the fire box 11 of the heating boiler 10, a gasification burner 12 is arranged. Through a line 13, fuel in the form of heating oil is fed to the burner 12 and air is fed through a line 14. For transporting the fuel serves a pump 15, and for feeding-in the air, a compressor 16. The oil pump 15 and the air compressor 16 are mounted together on the drive shaft 17 of a motor 18. In the fuel feed line 13 is arranged as a bypass to the pump 15 a line 19 with a valve 20, and in the air feed line 14, as a bypass to the compressor 16, a line 21 with a valve 22. Flowwise downstream from the shunt 21, i.e., between the compressor 16 and the burner 12, a valve 23 is arranged in the air feed line 14 and divides the total air stream into gasification air and combustion air, which are fed to the burner 12 separately via lines 24 and 25.

In the water loop 26 of the heating boiler 10, a circulating pump 27 is arranged; the load, i.e., the user, is designated with the numeral 28. The lambda-probe 30 is exposed to the exhaust gas stream of the burner 12; it can, therefore, be arranged, for example, in the exhaust gas pipe 29 of the heating boiler 10.

In the operation of the gasification burner/heating boiler installation, the outside air temperature is determined by a sensor 31 and the outgoing boiler temperature by a sensor 32, and is transmitted to a control and regulating unit 35 via lines 33 and 34, respectively. The signal of the lambda-probe 30 is fed to the control and regulating unit 35 via a line 36.

The speed of the motor 18 is controlled by the control and regulating unit 35 via a line 37, whereby the flow of fuel and air is controlled as a function of the burner output. From the control and regulating unit 35 a line 38 further leads to the valve 20 (in the bypass line 19 of the fuel feed line 13), and a line 39 leads to the valve 22 (in the bypass line 21 of the air feed line 14). Deviations from the stoichiometric ratio between fuel and air can then be controlled by operating the valves 20 and 22. Finally, a line 40 further leads from the control and regulating unit 35 to valve 23 in the air feed line 14. The ratio between gasification air and combustion air, which in general is 1:9, can be adjusted by the valve 23.

Figure 3:
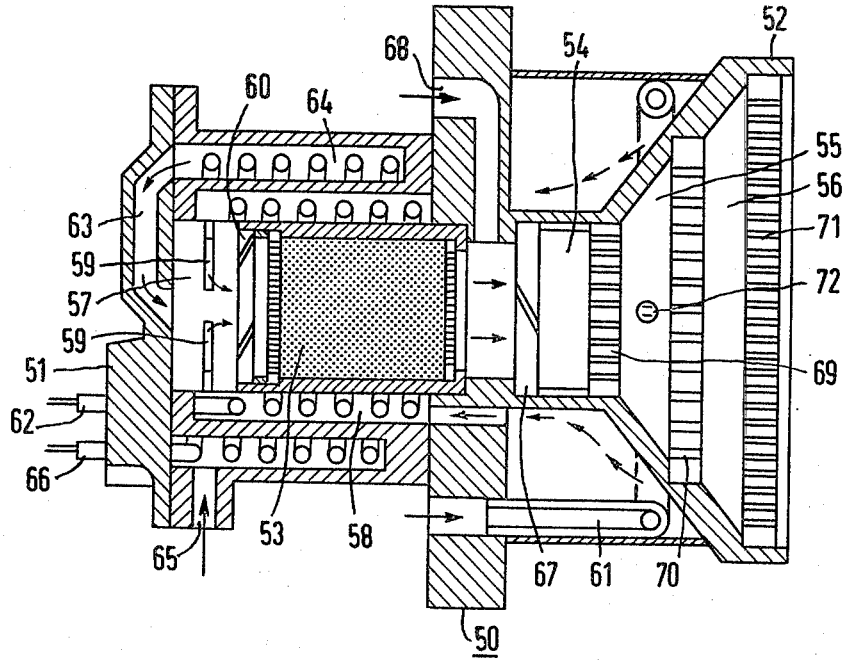
FIG. 3 is a cross-sectional view of a preferred embodiment of the gasification burner used with the method according to the present invention.

In FIG. 3, a preferred embodiment of the gasification burner used with the method according to the present invention is shown (see DE-OS No. 28 41 105).

The gasification burner 50 consists essentially of two stages, a gasification part 51 with a centrally arranged reactor chamber 53 which contains a catalyst, and a combustion part 52 which comprises a mixing chamber 54, an ignition chamber 55 and a combustion chamber 56. The reaction chamber and the catalysis device 53, respectively, are preceded by an ante-chamber 57 for mixing the fuel with gasification air. To this end, the gasification air is fed to the ante-chamber 57 from a so-called ring or annular space 58 through radial ducts or canals 59 which connect the ante-chamber to the ring space 58 (which is separated from the ante-chamber by a ring wall), and is mixed with the fuel at a homogenizing device 60, for example, a twisting orifice provided with inclined slots. In the ring space 58, to which the gasification air is fed via an inlet 61, a source of heat 62 is provided for preheating the air upon starting the burner and in the case of load changes. To feed the fuel to the ante-chamber 57, the latter is preceded by a so-called front chamber 63 which merges into a ring canal 64. The ring canal 64, to which the fuel is fed via a line 65 is provided with a source of heat 66 for evaporating the liquid fuel during the starting process.

Figure 2:
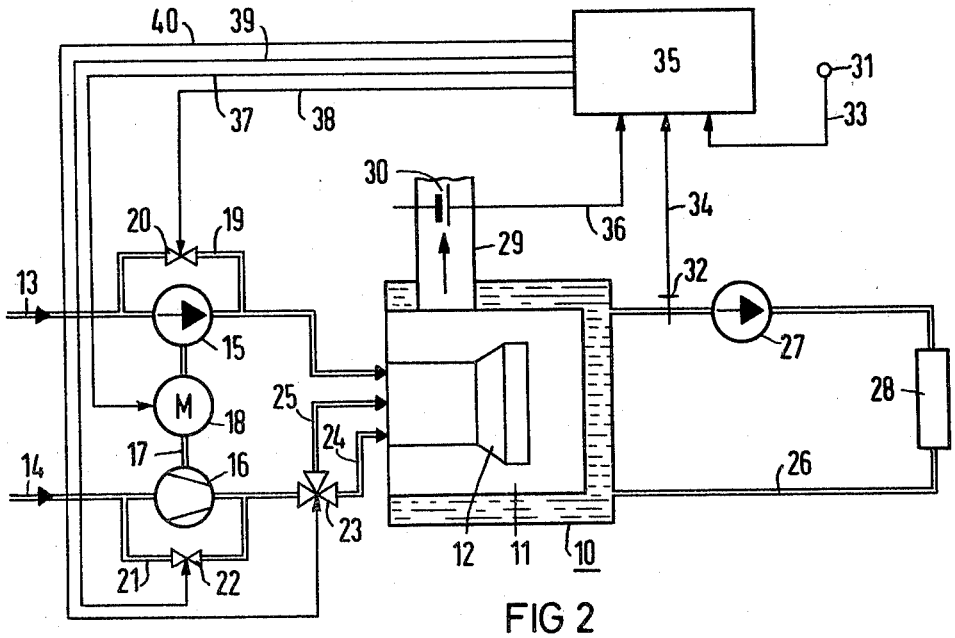
FIG. 2 schematically shows the control and regulation arrangement to the method of the present invention with reference to an embodiment of a gasification arrangement.

In the reactor chamber 53, the fuel is converted by partial oxidation into a fuel gas which is fed to the mixing chamber 54 and is mixed there at a homogenizing device 67, for example, a twisting orifice provided with inclined slots, with the combustion air. The combustion air is fed to the mixing chamber 54 through an inlet 68. The fuel gas/combustion air mixture enters the ignition chamber 55 from the mixing chamber 54 through a perforated disc 69 serving as backfire protection, and from there through a so-called perforated wall 70 into the combustion chamber 56 which is closed off from the outside by a gas-permeable burner plate 71. When flowing through the ignition chamber 55 into which an ignition electrode 72 projects, and through the combustion chamber 56 especially when passing through the perforated wall 70 and the burner plate 71, both of which are also called flame plates, the fuel gas/combustion air mixture burns up and then passes as exhaust gas into the interior of the heating boiler, i.e., the fire box (see also FIG. 2, numeral 11), where it serves for heating the boiler water.

In the method according to the present invention, it has been found to be advantageous, as already described, to arrange the lambda-probe in the fire box of the heating boiler, since satisfactory operation of the lambda-probe is obtained only at temperatures above about 300° C. The lambda-probe is, therefore, attached preferably in the fire box in the vicinity of the last flame plate, i.e., the so-called burner plate (see FIG. 3, numeral 71). If this is not possible for space reasons, the operating temperature of the lambda-probe can advantageously also be maintained by an electric heater.

It is a further prerequisite for proper control that, with a stoichiometric input material mixture, no free oxygen is measured in the exhaust gas, as may be the case, when a high-temperature equilibrium is "frozen." In order to fulfil these conditions, the thermodynamic equilibrium must be adjusted in the measuring gas at temperatures so low that practically only $CO_2$ and $H_2O$ occur as combustion products. This is the case at temperatures between about 300 to 1000° C. and preferably at about 500° C. if the measuring gas is fed to the measuring electrode of the lambda-probe via a catalyst which adjusts the low-temperature equilibrium, or if the electrode material itself adjusts the low-temperature equilibrium. Such catalysts or electrode materials are, for example, platinum and rhodium.

What is claimed is:

1. In a method for operating a gasification burner/-heating boiler installation, said installation comprising a fire box in which a burner for gasifying fuel oil is arranged, and wherein, in said burner, fuel oil fed to said burner by a fuel oil feeding means is gasified and combusted with air fed to said burner by an air feeding means, the improvement comprising determining the required burner output from the ambient air temperature; controlling mass flows of the fuel oil and air to the burner as a function of the burner output; and controlling deviations from the stoichiometric ratio between fuel oil and air by means of a lambda-probe arranged in the exhaust gas stream of said boiler.

2. The method according to claim 1 wherein the lambda-probe is arranged at least partially in the fire box of the heating boiler.

3. The method according to claim 1 wherein the lambda-probe is heated electrically.

4. The method according to claim 1 wherein deviations from the stoichiometric ratio between fuel oil and air are leveled out by changing a bypass to the fuel oil feeding means or to the air feeding means.

5. The method according to claim 1 wherein the air and fuel oil mass flows are adjusted by controlling bypasses to the air feeding means and to the fuel oil feeding means.

6. The method according to claim 1 wherein the air and fuel oil mass flows are adjusted by controlling the throughput of the air feeding means and/or the fuel oil feeding means.

7. The method according to claim 1 wherein the fuel oil feeding means is a fuel oil pump and the air feeding means is an air compressor.

8. The method according to claim 7 wherein a common drive is provided for the air compressor and the fuel oil pump, and the air and fuel oil mass flows are adjusted by speed control of the common drive.

* * * * *